US005595508A

United States Patent [19]

Tsuji et al.

[11] Patent Number: 5,595,508

[45] Date of Patent: Jan. 21, 1997

[54] CONNECTOR HOUSING

[75] Inventors: Masanori Tsuji; Motohisa Kashiyama; Satoki Masuda, all of Shizuoka, Japan

[73] Assignee: Yazaki Corporation, Tokyo, Japan

[21] Appl. No.: 365,362

[22] Filed: Dec. 28, 1994

[30] Foreign Application Priority Data

Dec. 28, 1993 [JP] Japan ..... 5-350569

[51] Int. Cl.[6] ..... H01R 13/514

[52] U.S. Cl. ..... 439/752

[58] Field of Search ..... 439/733, 752, 439/596

[56] References Cited

U.S. PATENT DOCUMENTS

| | | | |
|---|---|---|---|
| 4,767,361 | 8/1988 | Hoshino et al. | 439/752 |
| 4,900,277 | 2/1990 | Inaba et al. | 439/752 |
| 5,037,336 | 8/1991 | Betsui | 439/752 |
| 5,044,972 | 9/1991 | Ikeda | 439/752 |
| 5,106,326 | 4/1992 | Tsuji et al. | 439/596 |

FOREIGN PATENT DOCUMENTS

| | | | |
|---|---|---|---|
| 2046488 | 3/1972 | Germany | 439/752 |

*Primary Examiner*—David L. Pirlot
*Assistant Examiner*—Eugene G. Byrd
*Attorney, Agent, or Firm*—Sughrue, Mion, Zinn, Macpeak & Seas

[57] ABSTRACT

A connection terminal is retained by a retaining lance which is a primary retaining member formed in a terminal receiving chamber. In addition, in a terminal insertion port at the rear end of the terminal receiving chamber, a rear holder having retaining projections provided on the side walls and a U-shaped wire holding portion is provided as a secondary retaining member. Retaining holes engageable with the retaining projections are provided on side walls of the terminal receiving chamber. A displacement preventing member having a width which is substantially equal to a width of a U-shaped opening of the wire holding portion is extended rearward at the rear end of an upper circumferential wall of the terminal receiving chamber. This displacement preventing member is inserted into the wire holding portion under the condition where the rear holder is locked. Accordingly, the rear holder is held between the side walls of the terminal receiving chamber and the displacement preventing member so that the secondary retaining member is surely prevented from being released from retaining.

6 Claims, 5 Drawing Sheets

CONNECTOR HOUSING

BACKGROUND OF THE INVENTION

1. Field of the Invention

The present invention relates to a connector housing used for electrically connecting a wire harness of an automobile or the like, and particularly to a connector housing to which a rear holder is attached so that a connection terminal inserted into a terminal receiving chamber of the connector housing is prevented from coming off.

2. Related Art

Conventionally, there is known a connector housing having a double retaining structure which prevents a connection terminal to be inserted into the connector housing from being detached therefrom, for example, as disclosed in JP-U 64-12384.

In such a conventionally known connector housing, as shown in FIGS. 5 and 6, a female connector 31 and a male connector 32 each made of hard synthetic resin are fitted to each other. A box-like retaining member 33 with a retaining projection 34 is provided integrally on one outer circumferential surface of the female connector 31 at its front portion. A retaining plate 35 with a retaining projection 36 is provided integrally on one outer circumferential surface of the male connector 32 at its front portion. The retaining projection 34 is engaged with the retaining projection 36 so that the male connector 32 is fitted into the female connector 31.

Accompanied with this fitting, the front portions of connection terminals 43 and 44 are retained in terminal receiving chambers 37 and 38 of the male and female connectors 31 and 32 respectively, by member of retaining arms 41 and 42 respectively having retaining projections. The retaining arms 41 and 42 are provided in the terminal receiving chambers 37 and 38 so as to form primary retaining members 39 and 40 respectively.

Rear holders 49 and 50 are integrally provided on the rear end portions of the female and male connectors 31 and 32 through hinges 51 and 52 so as to form secondary retaining members 47 and 48 respectively, thereby retaining base expanded portions 43*a* and 44*a* of the connection terminals 43 and 44 provided at the base portions thereof so as not to come off connectors 31 and 32.

The configuration of the male connector 32 will be described. The female connector 31 also has a configuration similar to the male connector 32.

Retaining projections 54 are provided respectively on the opposite side surfaces of the rear holder 50 as shown in FIGS. 7 and 8 so as to be engaged with and stopped by retaining holes 56 provided respectively in the opposite side walls of the terminal receiving chamber 38. Since the rear holder 50 is designed so as to be pivotal on the hinges 52, a wire holding portion 58 of the rear holder 50 for holding a connection wire 46 at its circumference is opened in one direction to form a U-shaped configuration.

On the above configuration, first, the connection terminal 44 to which the connection wire 46 is clamped or attached by the pressure is inserted into the terminal receiving chamber 38 of the male connector 32 as shown in FIG. 6. Then, the connection terminal 44 is primarily retained in the terminal receiving chamber 38 by the retaining arm 42 with a retaining projection constituting the primary retaining member 40. When the male connector 32 is inserted to the front portion of the female connector 31, the retaining plate 35 is fitted into the retaining member 33 so that the male connector 32 is fitted into the female connector 31 and at the same time the connection terminals 43 and 44 are electrically connected to each other.

Thereafter, when the rear holder 50 is pushed into the opening portion of the terminal receiving chamber 38 while the rear holder 50 is pivoted on the hinges 52, the retaining projections 54 are engaged with the retaining holes 56 so that the rear holder 50 is fixed in the opening portion of the terminal receiving portion 38. Thus, the base expanded portion 44*a* of the connection terminal 44 is also engaged with the rear holder 50, so that the connection terminal 44 is doubly retained in the terminal receiving chamber 38.

However, if the wire 46 is thinner than the U-shaped width of the wire holding portion 58, the side walls of the terminal receiving chamber 38 or the U-shaped opening portion of the wire holding portion 58 of the rear holder 50 is deformed when an external force acts on the terminal receiving chamber 38 or the connection wire 46 in the transverse direction thereof as shown in FIG. 8. As a consequence, there may arise a disadvantage that the retaining projections 54 are detached from the retaining holes 56 and so the reliability of the secondary retaining member 48 is degraded.

SUMMARY OF THE INVENTION

It is therefore an object of the present invention to solve the foregoing problem and to provide a connector housing in which a secondary retaining member is not released easily by the effect of an external force, so that it is possible to reliably perform double retaining.

The foregoing object of the present invention is attained by a connector housing in which a primary retaining member for retaining a connection terminal is provided in a terminal receiving chamber in which the connection terminal is inserted, a U-shaped wire holding portion is provided in which a connection wire of the connection terminal is inserted and held therein, and a rear holder is provided so as to cover a terminal insertion port provided at a rear end portion of the terminal receiving chamber to thereby act as a secondary retaining member of the connection terminal, wherein the rear holder is locked on side walls of the terminal insertion port so as to retrain the connection terminal doubly after the connection terminal is inserted into the terminal receiving chamber, characterized in that a displacement preventing member having a width substantially equal to a width at a U-shaped opening portion of the wire holding portion is inserted into a U-shaped opening portion of the wire holding portion when the rear holder is locked.

The above object is also attained by a displacement preventing member which extends out from a rear end of a circumferential wall constituting the terminal receiving chamber, and a taper portion which is provided at a rear portion of the displacement preventing member.

In the connector housing having such a configuration according to the present invention, when the connection terminal to which a connection wire is press fitted is inserted into the terminal receiving chamber, the connection terminal is retained by the primary retaining member. A rear holder which acts as the secondary retaining member is pushed and locked into the terminal insertion port, so that the connection terminal is retained in the terminal receiving chamber doubly. At this time, the displacement preventing member, which is extended backward on a circumferential wall constituting the terminal receiving chamber and having a taper portion on the top thereof, is inserted into a U-shaped opening portion of the rear holder to thereby prevent the rear holder from being displaced. Accordingly, even if an external force such as a shock acts on the terminal receiving chamber or the wire, there is no little chance that the rear holder will be released from the locked position. It is therefore possible to improve the reliability of the retaining member of the connection terminal.

DETAILED DESCRIPTION OF THE PREFERRED EMBODIMENTS

Figure 1:
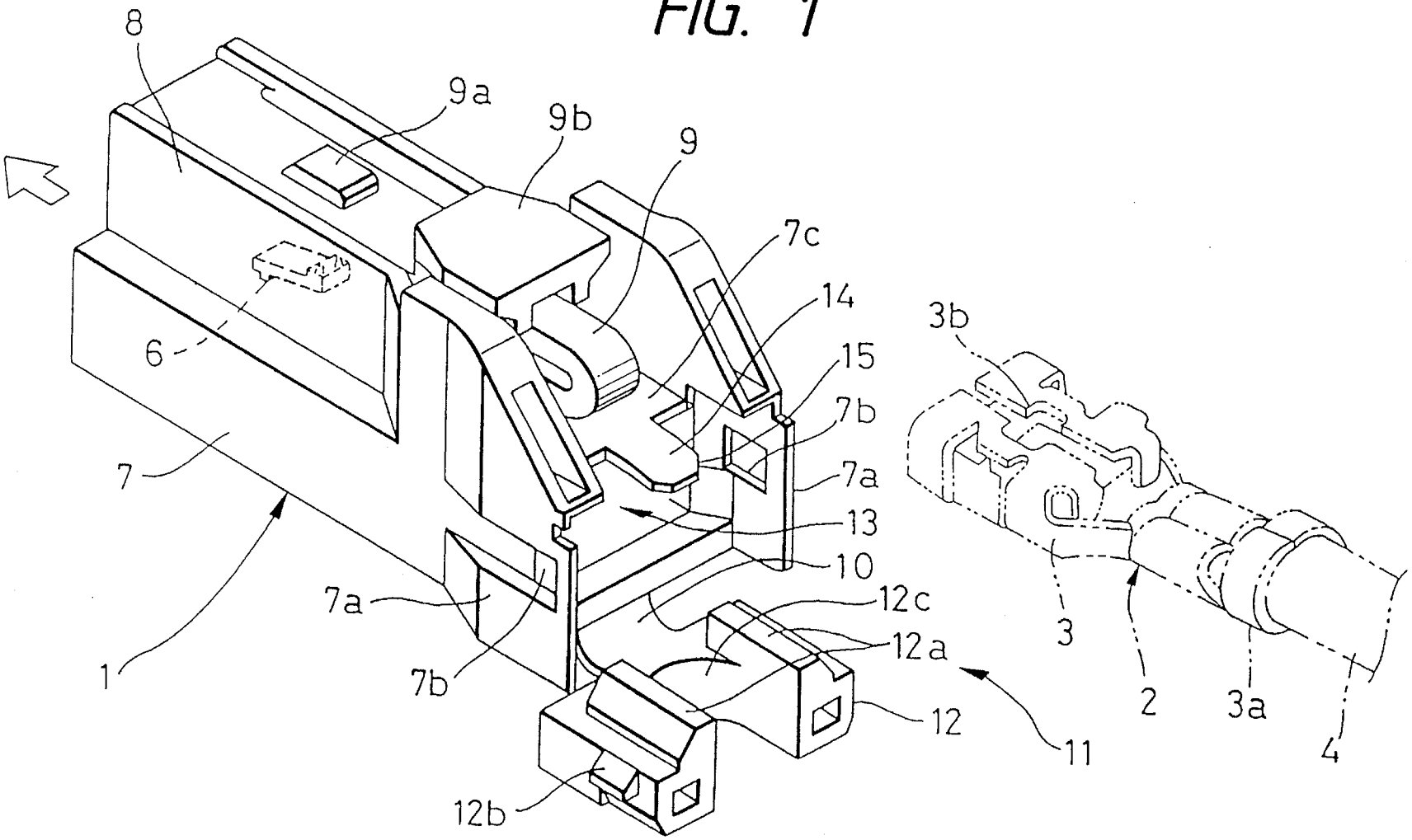
FIG. 1 is a perspective view illustrating a male connector housing according to an embodiment of the present invention.
Figure 2:
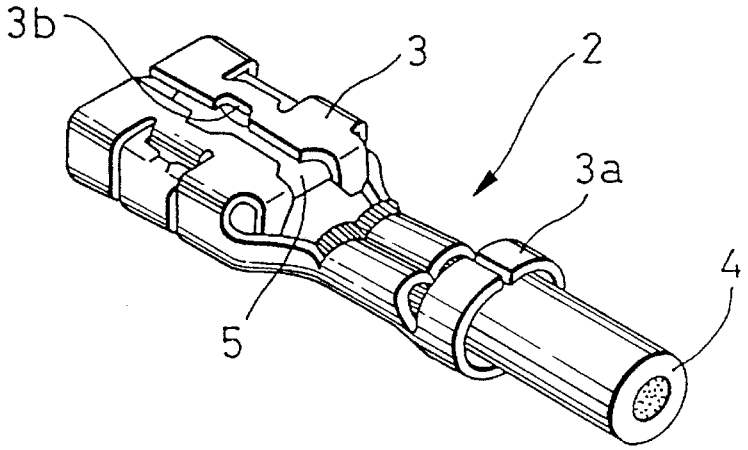
FIG. 2 is a perspective view illustrating a female connector to be inserted into the male connector housing of FIG. 1.
Figure 3:
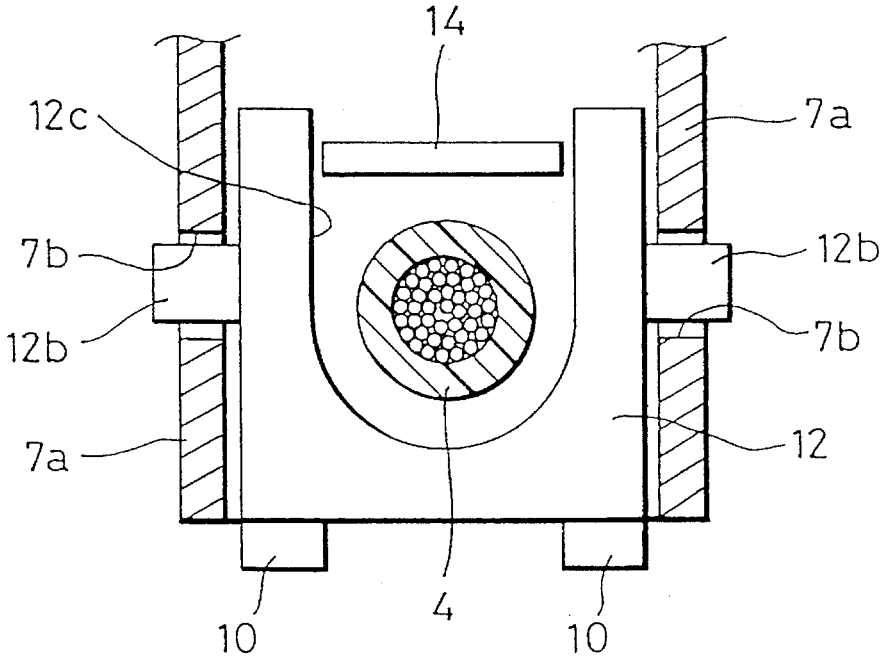
FIG. 3 is a sectional view illustrating a rear holder used for explaining the operation of the rear holder and showing the state where the female connector is inserted into the male connector housing of FIG. 1.
Figure 4:
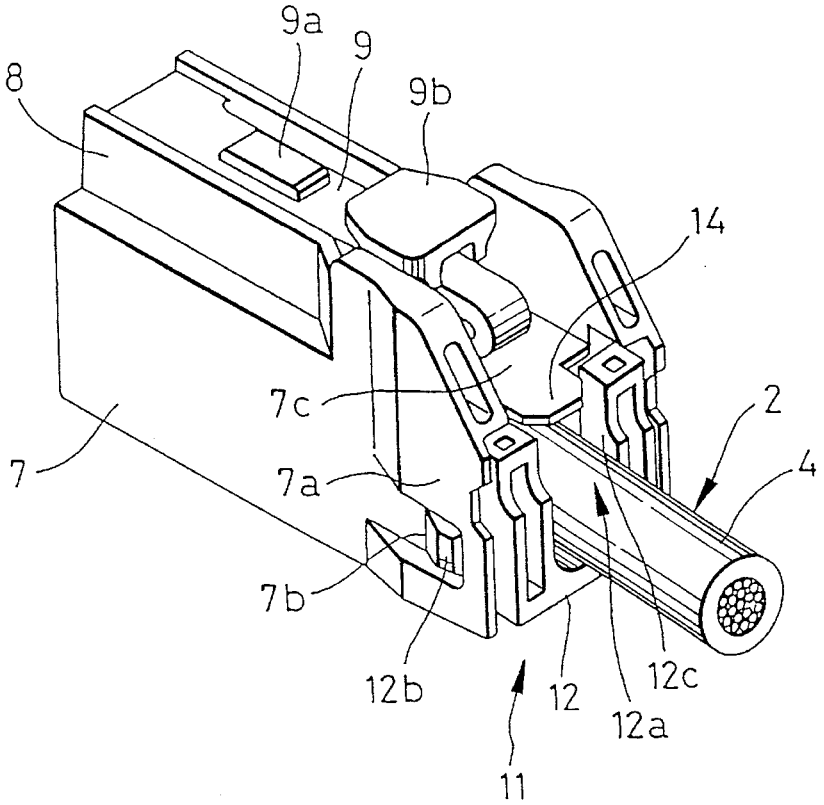
FIG. 4 is a perspective view of the male connector housing of FIG. 1, showing the state where the rear holder is locked.
Figure 5:
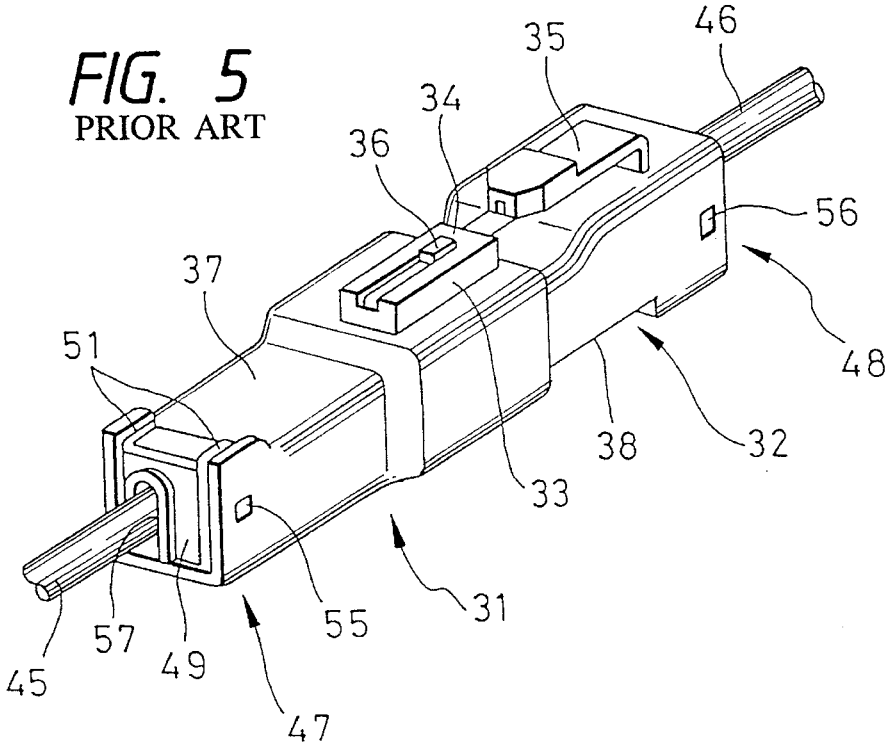
FIG. 5 PRIOR ART
FIG. 5 is a perspective view illustrating the state where prior art female and male connector housings are fitted to each other.
Figure 6:
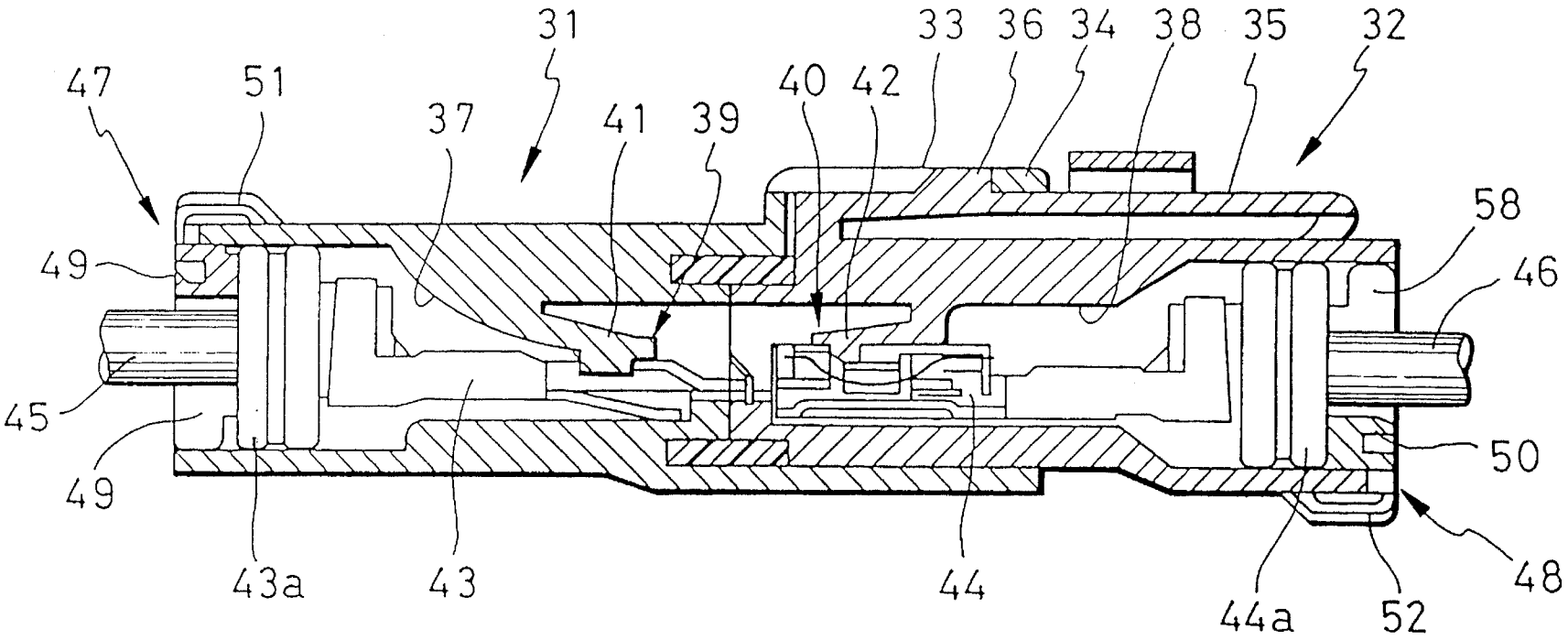
FIG. 6 PRIOR ART
FIG. 6 is a sectional view illustrating the fitting state of FIG. 5.
Figure 7:
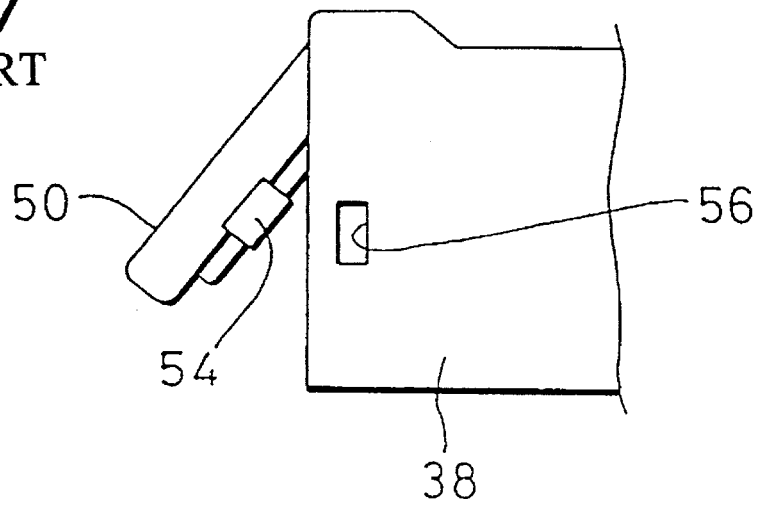
FIG. 7 PRIOR ART
FIG. 7 is a partial side view of the rear holder of FIG. 5.
Figure 8:
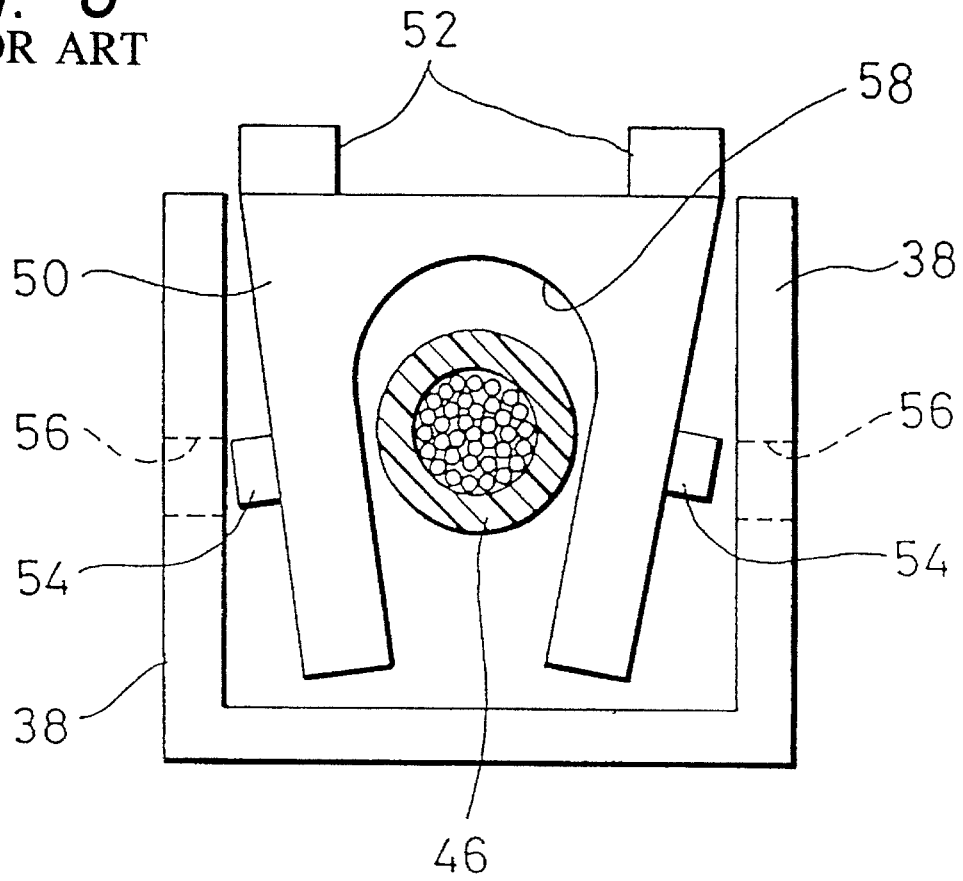
FIG. 8 PRIOR ART
FIG. 8 is a sectional view illustrating the rear holder used for explaining operation in the state of FIG. 5 where the rear holder is locked.

The connector housing according to an embodiment of the present invention will be described with reference to FIGS. 1 to 4. FIG. 1 is a perspective view illustrating a male connector housing according to the present invention; FIG. 2 is a perspective view illustrating a female terminal to be inserted into the male connector housing shown in FIG. 1; FIG. 3 is a sectional view illustrating a rear holder used for explaining the operation of the rear holder and showing the state in which the female terminal is inserted in FIG. 1; and FIG. 4 is a perspective view of the male connector housing portion, showing the state in which the rear holder is locked in FIG. 1. The present invention is not limited to the following embodiment. In addition, although an embodiment of the present invention illustrates a case where the present invention is applied to a male connector housing, the present invention may also be applied in the same manner to a female connector housing, and therefore the male connector housing will be hereinafter simply called "housing" representatively.

As shown in FIG. 1, at the front portion of a housing 1 made of hard synthetic resin, there is formed a terminal receiving chamber 7 for receiving a connection terminal and a connection portion 8 to be fitted to its mate housing. The direction of "front" of the housing 1 is indicated by an arrow in the left of the housing 1 in FIG. 1. An retaining lance 6 having a retaining projection serving as a primary retaining member, which is provided also in a conventional connector housing, is provided on the inner wall surface of this terminal receiving chamber 7.

In the inside of the connection portion 8, a retaining plate 9 in the form of a leaf spring is provided integrally with the upper circumferential wall constituting the terminal receiving chamber 7 so that a retaining projection **9*a*** is engageable with a retaining reception portion of its mate housing to thereby make the housings fit to each other.

When pressure is applied downward to a push member **9*b*, the retaining plate 9** is bent down so that the fit state of the housing with its mate housing is released.

A rear holder 12 is provided integrally, through a hinge 10, with the lower circumferential wall of the terminal receiving chamber 7 at its rear end so that a secondary retaining member 11 is formed here. A pair of retaining pieces **12*a* are provided on the inner surface of this rear holder 12 so that the retaining pieces 12*a* come into contact with an expanded press fitting portion 3*a* of a connection terminal 2 to thereby prevent the connection terminal 2 from coming off when the connection terminal 2 is inserted into the terminal receiving chamber 7. In addition, a pair of retaining projections 12*b* for locking are provided on the opposite side surfaces of the rear holder 12. Further, a U-shaped wire holding portion 12*c* opened upward (in the state of FIG. 3) is provided in the center portion of the rear holder 12 so as to surround, on its three sides, a wire portion 4 of the connection terminal 2 to thereby hold the wire portion 4 when the connection terminal 2 is inserted into the terminal receiving chamber 7**.

A pair of retaining holes **7*b* respectively engageable with the retaining projections 12*b* of the rear holder 12 are provided in the opposite side walls 7*a* of the terminal receiving chamber 7 at its rear end portion so that the retaining holes 7*b* are engaged respectively with the retaining projections 12*b* when the rear holder 12 is pivoted on the hinge 10 and inserted into a terminal insertion port 13 formed at the rear end portion of the terminal receiving chamber 7**.

Further, a plate-like displacement preventing member 14 having a width which is substantially equal to the width of the U-shaped opening portion of the wire holding portion **12*c* is extended rearward from the rear end portion of an upper circumferential wall 7*c* of the terminal receiving chamber 7. Since this displacement preventing member 14 is inserted into the U-shaped opening portion of the wire holding portion 12*c* when the rear holder 12 is inserted into and locked in the terminal insertion port 13, taper portions 15 are provided on a top end portion of the displacement preventing member 14 to facilitate the inserting operation of the displacement preventing member 14**.

Such a female connection terminal 2 as shown more in detail in FIG. 2 is inserted into the terminal receiving chamber 7 of the housing 1 having such a configuration as described above. This connection terminal 2 is constituted by a connection portion 3 and a press fitting portion **3*a* for caulking or clamping the wire portion 4. The connection portion 3 is formed like a box so as to receive the top end portion of its mate connection terminal, thereby ensuring electrical connection by a leaf spring 5. A retaining hole 3*b* for primary retaining is provided at the center of the upper surface of the connection portion 3**.

As shown FIGS. 1 and 4, first, when the connection terminal 2 is inserted into the terminal receiving chamber 7 through the terminal insertion port 13 of the housing 1, the retaining hole **3*b* of the connection portion 3 of the connection terminal 2 is engaged with the retaining lance 6 of the housing 1 so that the connection terminal 2** is retained primarily.

Next, when the rear holder 12 is pivoted on the hinge 10 so as to be inserted into the terminal insertion port 13, the retaining projections 12*b* are engaged with the respective retaining holes 7*b* as shown in FIG. 4, so that the rear holder 12 is locked in the terminal insertion port 13. At this time, the retaining pieces 12*a* are in contact with the rear end of the press fitting portion 3*a* of the connection terminal 2 so that the connection terminal 2 is retained secondarily so as to be prevented from coming off. That is, the connection terminal 2 is retained in the terminal receiving chamber 7 doubly by the retaining lance 6 and the rear holder 12.

The operation of the displacement preventing member 14 will be described under the condition where the rear holder 12 is locked in the terminal insertion port 13 as mentioned above.

As shown in FIG. 3, since the displacement preventing member 14 is fitted into the U-shaped opening portion of the wire holding portion 12*c*, the rear holder 12 is held between the displacement preventing member 14 and the side walls 7*a* of the terminal receiving chamber 7. Accordingly, even if an external force such as a shock acts on the side walls 7*a* of the terminal receiving chamber 7 or acts on the wire portion 4, the U-shaped wire holding portion 12 itself remains held, so that there is no fear that the wire holding portion 12 is transformed. That is, there is little chance that the retaining projections 12*b* of the rear holder 12 are detached from the retaining holes 7*b*, so that there is also little chance that the connection terminal 2 is released from the secondary retaining member, the rear holder 12. Accordingly, a reliable retaining state can be maintained.

In addition, since the taper portions 15 are provided on the top of the displacement preventing member 14, the insertion of the rear holder 12 into the terminal insertion port 13 is made so easy as to improve the workability.

The present invention is not limited to the above embodiment, and it can be realized in other aspects with desired modifications. For example, although the displacement preventing member 14 is provided by extending rearward from the upper circumferential wall 7*c* of the terminal receiving chamber 7, the rear end of the retaining plate 9 may be extended rearward so as to be inserted into the U-shaped opening portion of the wire holding portion 12*c* to thereby also serve as the displacement preventing member 14.

As described above, according to the connector housing of the present invention, the rear holder is provided as the secondary retaining member for retaining the connection terminal in the terminal receiving chamber, and the displacement preventing member having the width which is substantially equal to the width of the U-shaped opening portion of the wire holding portion of the rear holder is inserted into the U-shaped opening portion. Accordingly, there is little chance that the wire holding portion of the rear holder or the side wall of the terminal insertion port will be transformed by an external force such as a shock to thereby release the secondary retaining member. It is therefore possible to ensure the double retaining of the connection terminal, and hence to improve the reliability of the connector.

In addition, since the taper portions are provided on the top of the displacement preventing member, the insertion of the displacement preventing member into the wire holding portion is made easy, so that it is possible to improve the workability.

What is claimed is:

1. A connector housing comprising:

a retaining member for retaining a terminal, the retaining member being provided in a terminal receiving chamber in which the terminal is inserted, a rear holder connected to the connector housing through a hinge at a rear end portion of the terminal receiving chamber, the rear holder having a U-shaped wire holding portion extending completely through the rear holder for holding the terminal in the terminal receiving chamber; and a displacement preventing member arranged in the terminal receiving chamber for restraining lateral movement of the U-shaped wire holding portion, the displacement preventing member having a width substantially equal to a width of the U-shaped wire holding portion, and the displacement preventing member being inserted into the U-shaped wire holding portion when the rear holder is locked.

2. A connector housing as claimed in claim 1, wherein the displacement preventing member is extended out from a rear end of a circumferential wall which is included in the terminal receiving chamber.

3. A connector housing as claimed in claim 2, wherein a taper portion is provided at a rear end portion of the displacement preventing member.

4. A connector housing as claimed in claim 1, further including means for locking the rear holder on side walls of a terminal insertion port of the connector housing so as to restrain the terminal after the terminal is inserted into the terminal receiving chamber.

5. A connector housing as claimed in claim 4, wherein the means for locking includes retaining projections provided on side surfaces of the rear holder and retaining holes provided in side walls of the terminal receiving chamber, the retaining projections being engageable with the retaining holes.

6. A connector housing as claimed in claim 4, wherein the rear holder further comprises retaining pieces provided on an inner surface of the rear holder for retaining the terminal in the terminal receiving chamber.

* * * * *